United States Patent [19]

Conca et al.

[11] 4,086,129

[45] Apr. 25, 1978

[54] PROCESS FOR CONTROLLING THE INTRINSIC VISCOSITY OF SULFITE PULP

[75] Inventors: Romeo John Conca; John Patrick Gray, both of Shelton; Tod Hunter Sloan, Tumwater, all of Wash.

[73] Assignee: International Telephone and Telegraph Corporation, New York, N.Y.

[21] Appl. No.: 628,328

[22] Filed: Nov. 3, 1975

[51] Int. Cl.[2] ..... G01N 21/20; D21C 3/22; D21C 7/12

[52] U.S. Cl. ..... 162/49; 162/61; 23/230 A

[58] Field of Search ..... 162/238, 49, DIG. 10, 162/61, 62; 23/253 A, 230 A; 73/53, 61 R; 356/201; 235/151.35

[56] References Cited

U.S. PATENT DOCUMENTS

| | | | |
|---|---|---|---|
| 2,615,339 | 10/1952 | Holgersson | 162/49 X |
| 3,555,204 | 1/1971 | Anderson | 23/253 A |
| 3,748,044 | 7/1973 | Linton | 73/53 |
| 3,837,217 | 9/1974 | Schulz | 73/53 |
| 3,941,649 | 3/1976 | Wallin | 162/238 |

FOREIGN PATENT DOCUMENTS

| | | | |
|---|---|---|---|
| 747,108 | 3/1956 | United Kingdom | 162/49 |

OTHER PUBLICATIONS

Pulping Processes; Rhydholm; pp. 439–451, New York, 1967.

MacDonald, Editor "Pulp and Paper Manufacture", p. 150, McGraw-Hill Book Company, New York, 1969.

*Primary Examiner*—S. Leon Bashore
*Assistant Examiner*—Steve Alvo
*Attorney, Agent, or Firm*—J. B. Raden; H. J. Holt

[57] ABSTRACT

A process for accurately controlling the intrinsic viscosity of sulfite pulp at the termination of a digestion operation comprising predetermining the duration of digestion time required to obtain a given pulp intrinsic viscosity for a range of initial weight ratios of combined $SO_2$ to wood, determining during the digestion operation the initial weight ratio of combined $SO_2$ to wood by measuring the rate of change of absorbance in the digestion cooking liquor and terminating the digestion operation at a time corresponding to the predetermined time required to obtain the given pulp intrinsic viscosity at the aforesaid combined $SO_2$ to wood ratio.

4 Claims, 2 Drawing Figures

PROCESS FOR CONTROLLING THE INTRINSIC VISCOSITY OF SULFITE PULP

Figure 1:
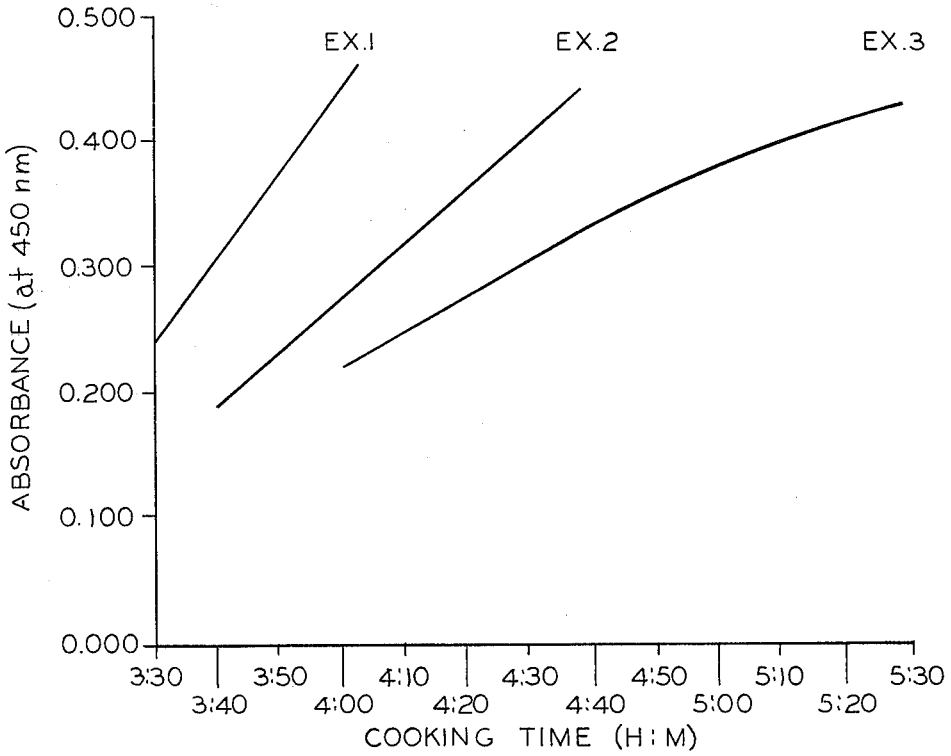

This invention relates to a process for accurately controlling the intrinsic viscosity of sulfite pulp at the termination of a digestion operation.

In the sulfite digestion of wood, the end-point determination of the cook is of critical importance. The key measurement of dissolving pulp properties, intrinsic viscosity (I.V.), is directly dependent on the duration of cook. In order to obtain a target I.V., the digestion must be terminated with precision. In practice, no method has as yet been devised for precise determination of the end-point.

The most commonly used method of end-point determination is by visual inspection of the color of the cooking liquor. Cooking acid color is known to bear an intimate relationship to pulp viscosity. Color observation is however insufficiently precise to produce pulp of uniform viscosity from cook-to-cook. Moreover, determination of the end-point by observation of the color of the cooking liquor means that the duration of a given cooking cycle is not known until that cooking cycle is terminated. It would be very desirable for production scheduling purposes to know in advance the length of a digestion cycle so that the many interrelated operations of a pulping mill could be more precisely scheduled.

In addition to digestion time, the basic process controlling elements in the sulfite digestion process are pressure and temperature. These three parameters are in turn adjusted according to the initial amount of cooking chemical and wood present in the digester. In practice however, it is not possible to know precisely how much cooking chemical and wood are present in a given cook. Nonuniform filling of the digester, differences in wood density or moisture and periodic swings in chemical strength of cooking acid all contribute to the inherent variation which makes precise determination of the chemical to wood ratio difficult. Small variations in the chemical to wood ratio will produce serious miscalculations of the end-point determination.

Many approaches have been employed to determine the amount of cooking chemical and wood charged to the digester, including chip sampling, iodometric titration of the cooking liquor and others. A number of these approaches are set forth in *Pulping Processes,* S. A. Rydholm, Interscience Publishers, 1965 at pages 446 to 451. However, none have been successful for establishing the chemical-to-wood ratio at a time in the digestion cycle when this information can be used for controlling end-point determination.

It is accordingly a primary object of this invention to provide a process for the precise determination of the end-point of a sulfite digestion process.

It is an additional object of this invention to provide a process for determining the duration of a digestion cycle at a time well in advance of the end point of the cycle.

It is still an additional object of this invention to provide a process for more accurate control than has hitherto been possible of the intrinsic viscosity of dissolving pulp at the termination of a digestion operation.

It is still an additional object of this invention to reduce energy requirements through improved process control, to provide more uniform unbleached pulp properties and to improve yields in sulfite pulping operations.

It has now been discovered that the initial weight ratio of combined $SO_2$ to wood in a sulfite digestion process may be determined with a high degree of accuracy by measuring the rate of change of absorbance in the digestion cooking liquor. As used herein, absorbance refers to the amount of light energy absorbance by the cooking acid. The remaining energy transmitted is responsible for the color of the cooking acid. A given rate of change in absorbance has been found to be characteristic of a certain initial chemical-to-wood ratio which in turn may be directly correlated with the cooking time, or pressure and temperature, required to obtain a given pulp I.V. Thus, determination of the rate of change of absorbance in the cooking liquor can be used to accurately control the process parameters of a digestion cycle and the I.V. of the resulting pulp.

The process of the invention comprises predetermining the duration of digestion time and the rate of change in absorbance required to obtain a given pulp intrinsic viscosity for a range of initial weight ratios of combined $SO_2$ to wood, determining during a given digestion operation the initial weight ratio of combined $SO_2$ to wood by measuring the rate of change in absorbance in the digestion cooking liquor, comparing the thus measured rate of change of light absorbance with the predetermined rate of change of light absorbance for the given pulp intrinsic viscosity (i.e., as explained below with respect to FIG. 2) determining from said comparison the initial weight ratio of combined $SO_2$ to wood, and terminating the digestion operation at a time corresponding to the predetermined time required to obtain the given pulp intrinsic viscosity at the aforesaid combined $SO_2$ to wood ratio.

Production scheduling problems may prevent adjustment of the duration of a digestion operation. It is possible to utilize the present invention in such circumstances by altering the pressure and temperature of a given digestion operation to obtain a given pulp intrinsic viscosity while the termination time remains unchanged from that which was scheduled. In this case, the process involves predetermining the rate of change of absorbance in digestion cooking liquor required to obtain a given pulp intrinsic viscosity for a range of initial weight ratios of combined $SO_2$ to wood, determining during the given digestion operation the initial weight ratio of combined $SO_2$ to wood by measuring the rate of change of absorbance in the given digestion cooking liquor and then adjusting the pressure and temperature of the digestion operation to obtain the given pulp intrinsic viscosity.

Figure 2:
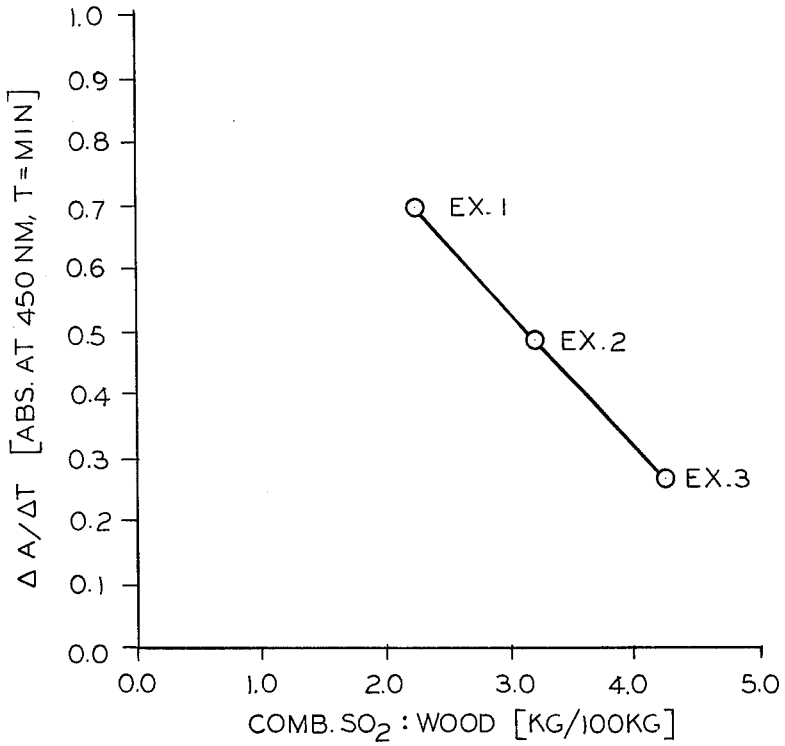

The invention will be better understood by reference to the accompanying drawing in which FIG. 1 is a graph of cooking time plotted against absorbance for three specific laboratory digestion operations, and FIG. 2 is a graph of the rate of change in absorbance versus combined $SO_2$:wood for the three digestion operations shown in FIG. 1.

The digestion time required to obtain a given I.V. may be predetermined for various combined $SO_2$ to wood ratios from empirical data obtained from mill digester operations or it may be obtained by laboratory experiments. For example, a series of digester cooks may be run in the laboratory in which all parameters of each cook are maintained constant, except for the combined $SO_2$ to wood ratio and the duration of the cooking operation. The cooking time at maximum temperature is varied to achieve a previously specified pulp viscosity.

The rate of change in absorbance of cooking liquor for each of the cooks is determined at the various combined $SO_2$ to wood ratios. With this data in hand, the combined $SO_2$: wood ratio as well as the duration of cooking time required will be known for any cook exhibiting the same rate of change in absorbance.

The rate of change in absorbance may be measured during a digestion operation by spectrophotometric analysis of the cooking acid. This may be done rather simply with a photometer, sample cell and associated lines from and to the sample cell and digester. The cooking liquor in the sample cell may then be irradiated with either monochromatic or white light. A conventional detector system is also required, e.g. vacuum phototubes or other types of photomultiplier. The wavelengths for which the detector response is measured is in the visible range (400 to 700 nanometer). (In the examples below 450 n.m. was chosen). The sample cell should (1) be of short path length (0.1 to 2.0 mm), (2) flow-through design and (3) have the ability to withstand temperatures and pressures to at least 150° C and 150 psig. The lines to the sample cell may comprise small bore (e.g. ¼ inch) stainless steel tubing originating from the body of the digester or the liquor circulation line which is connected to the flow-through sample cell in the analyzer. The return line can be routed back to the digester or to the sewer.

Determination of the rate of change in absorbance comprises the following operation: During the cooking acid filling of the digester, cooking acid is analyzed with respect to a reference material such as water or air. As the digester is heated, a continuous stream of cooking acid is passed through the analyzer. When the rate of change in absorbance becomes constant, the chemical-to-wood ratio can be determined. The slope of the absorbance-time curve is characteristic of a certain chemical-to-wood ratio, which in turn is then related to the predetermined duration of cooking time. With this knowledge in hand, a given cook can be terminated upon a fixed schedule with predictable pulp properties.

The following examples illustrate the practice of the invention. All parts are by weight unless otherwise indicated. Analyses and methods are in accordance with standards of the Technical Association of the Pulp and Paper Industry (TAPPI).

EXAMPLE 1–3

A laboratory digester of 6.5 cubic feet (0.18 cubic meters) was filled with 32.0 kilograms (oven dry wood basis) of western hemlock wood chips. Sodium-based cooking acid was introduced under pressure containing at least 6 grams/deciliter free $SO_2$ and no more than one gram/deciliter combined sulfur dioxide. Five times as much cooking acid as wood was charged to the digester. Indirect heating was employed to reach a maximum temperature of 142° C in 4 hours. The time at maximum temperature was varied to achieve a previously specified pulp viscosity-determined by dissolving a small sample of pulp in a solution of cupriethylene diamine. Digester pressure was regulated to maintain 110 psig. Three cooks were run varying only the chemical-to-wood ratio and the time at maximum temperature. Cooking acid absorbance was measured with a spectrophotometer in accordance with the technique outlined above. In Example 1–3, cooking time was varied to produce an absorbance interval of about 0.452 absorbance units. The data for the three cooking operations are set forth in the following table:

| Digester Charge | Example 1 | Example 2 | Example 3 |
|---|---|---|---|
| Wood | | | |
| Species | Hemlock | Same | Same |
| Percent O.D. (Oven Dry) | 52.2 | Same | Same |
| Weight, O.D. kg. | 8.4 | Same | Same |
| Cooking Acid, l. | 42.0 | Same | Same |
| Base | Sodium | Same | Same |
| Free $SO_2$, g./100 ml. | 7.21 | 7.19 | 7.21 |
| Comb. $SO_2$, g./100 ml. | 0.45 | 0.64 | 0.85 |
| Comb. $SO_2$:Wood, kg./100 kg. O.D. | 2.25 | 3.20 | 4.25 |
| Liquor:Wood | 5.00 | Same | Same |
| Cooking Schedule | | | |
| At Hrs:Min. | ° C. | ° C. | ° C. |
| 0:30 | 54 | Same | Same |
| 1:00 | 75 | Same | Same |
| 1:30 | 90 | Same | Same |
| 2:00 | 102 | Same | Same |
| 2:30 | 113 | Same | Same |
| 3:00 | 123 | Same | Same |
| 3:30 | 132 | Same | Same |
| 4:00 | 142 | Same | Same |
| Max. Temperature Reached, ° C. | 142 | Same | Same |
| Time to Max. Temp. | 4:00 | Same | Same |
| Time at Max. Temp. | 0:03 | 0:37 | 1:28 |
| Cooking Time, Hrs:Min. | 4:03 | 4:37 | 5:28 |
| Max. Pressure, Psig | 110 | Same | Same |
| Spent Liquor Test (Cold Liquor, After Blowdown) | | | |
| *Absorbance at 450 nm, 1mm path length | 0.46 | 0.44 | 0.45 |
| Pulp | | | |
| Screened Yield, % | 46.3 | 45.9 | 46.6 |
| Tailings, % | 0.5 | 0.4 | 0.3 |
| Cuene I.V., dl./g | 10.7 | 11.3 | 10.9 |
| K No., ml. (40 ml. determination) | 20.6 | 14.4 | 8.8 |

*Initial liquor absorbance was zero in each example.

The cooking time for the three example plotted against absorbance (at 450 nanometers) beginning at approximately maximum temperature is shown in FIG. 1. The rate of change in absorbance versus combined $SO_2$: wood ratio is plotted in FIG. 2. The three points shown in FIG. 2 are the slopes of the three examples shown in FIG. 1 at each of the combined $SO_2$: wood ratios of the respective examples.

The curve of FIG. 2 thus enables one to determine the chemical-to-wood ratio for a given rate of change in absorbance. With the chemical-to-wood ratio known, the precise predetermined duration of digestion time and hence termination time for a digestion operation may be determined from experimental data of the type set forth in Examples 1 through 3 or from previous mill experience.

The foregoing is a description of illustrative embodiments of the invention, and it is intended in the appended claims to cover all forms which fall within the scope of the invention.

We claim:

1. A process for the preparation of sulfite pulp of a given controlled intrinsic viscosity comprising predetermining the rate of change in light absorbance in digestion cooking liquor required to obtain a given pulp intrinsic viscosity for a range of initial weight ratios of combined $SO_2$ to wood, digesting particulate wood in the presence of sulfite cooking liquor, measuring the rate of change in light absorbance in the cooking liquor as the digestion proceeds comparing the thus measured rate of change of light absorbance with the predetermined rate of change of light absorbance for the given pulp intrinsic viscosity, determining from said comparison the initial weight ratio of combined $SO_2$ to wood, adjusting the time, temperature and pressure of the digestion operation to obtain the given controlled intrinsic viscosity at the aforesaid initial weight ratio of combined $SO_2$ to wood, and terminating the digestion operation in accordance with the adjusted time, temperature and pressure.

2. The process of claim 1 in which the time of digestion is predetermined and the pressure and temperature of the digestion operation are adjusted to obtain the given pulp intrinsic viscosity.

3. The process of claim 1 in which the pressure and temperature are predetermined and the duration of the digestion operation is adjusted to obtain the given pulp intrinsic viscosity.

4. The process of claim 1 in which the rate of change of light absorbance is measured by spectrophotometric analysis of a sample stream of the cooking liquor.

* * * * *